US011192362B2

(12) United States Patent
Kawamura et al.

(10) Patent No.: US 11,192,362 B2
(45) Date of Patent: Dec. 7, 2021

(54) LIQUID DISCHARGE HEAD, RECORDING APPARATUS USING THE SAME, AND RECORDING METHOD

(71) Applicant: KYOCERA Corporation, Kyoto (JP)

(72) Inventors: Hiroyuki Kawamura, Kirishima (JP); Wataru Ikeuchi, Kirishima (JP); Yifei Jiao, Shanghai (CN); Yusaku Kaneko, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/498,031

(22) PCT Filed: Mar. 29, 2018

(86) PCT No.: PCT/JP2018/013296
§ 371 (c)(1),
(2) Date: Sep. 26, 2019

(87) PCT Pub. No.: WO2018/181733
PCT Pub. Date: Oct. 4, 2018

(65) Prior Publication Data

US 2020/0031124 A1 Jan. 30, 2020

(30) Foreign Application Priority Data

Mar. 29, 2017 (JP) ..... JP2017-065413

(51) Int. Cl.
*B41J 2/14* (2006.01)

(52) U.S. Cl.
CPC ..... *B41J 2/14032* (2013.01); *B41J 2/14145* (2013.01); *B41J 2002/14338* (2013.01)

(58) Field of Classification Search
None
See application file for complete search history.

(56) References Cited

U.S. PATENT DOCUMENTS

2002/0196315 A1* 12/2002 Isono ..... B41J 2/14209 347/71
2005/0243149 A1* 11/2005 Matsumoto ..... B41J 2/17556 347/86

(Continued)

FOREIGN PATENT DOCUMENTS

EP 3246165 A1 11/2017
JP 2005-231038 A 9/2005

(Continued)

*Primary Examiner* — Erica S Lin
(74) *Attorney, Agent, or Firm* — Volpe Koenig

(57) ABSTRACT

A liquid discharge head 2 of the present disclosure includes: a flow path member 4 having a plurality of pressurizing chambers 10 connected to respective discharge holes 8, a first common flow path 20 commonly connected to the plurality of pressurizing chambers 10, and a second common flow path 22 commonly connected to the plurality of pressurizing chambers 10; and a plurality of pressurizing units 50 that pressurizes the respective pressurizing chambers 10, in which the first common flow path 20 extends in a first direction and is open to an outside of the flow path member 4 at both end portions, and the second common flow path 22 extends in the first direction and is open to the outside of the flow path member 4 at both end portions.

14 Claims, 5 Drawing Sheets

(56) References Cited

U.S. PATENT DOCUMENTS

| | | | | |
|---|---|---|---|---|
| 2007/0109373 | A1 | 5/2007 | Kojima | |
| 2008/0143793 | A1 | 6/2008 | Okuda | |
| 2010/0165020 | A1 | 7/2010 | Tojo et al. | |
| 2011/0096132 | A1* | 4/2011 | Kobayashi | B41M 5/0064 347/102 |
| 2012/0098881 | A1* | 4/2012 | Numata | B41J 29/377 347/16 |
| 2013/0208059 | A1 | 8/2013 | Arimoto | |
| 2015/0306875 | A1 | 10/2015 | Nishimura et al. | |
| 2016/0059547 | A1* | 3/2016 | Kaneko | B41J 2/17596 347/14 |
| 2016/0185113 | A1 | 6/2016 | Yoshida et al. | |
| 2017/0253037 | A1 | 9/2017 | Kobayashi | |
| 2017/0282544 | A1 | 10/2017 | Stephens et al. | |
| 2018/0264837 | A1 | 9/2018 | Matsuo et al. | |

FOREIGN PATENT DOCUMENTS

| | | | |
|---|---|---|---|
| JP | 2007-216418 | A | 8/2007 |
| JP | 2008-290292 | A | 12/2008 |
| JP | 2009-056766 | A | 3/2009 |
| JP | 2009-143168 | A | 7/2009 |
| JP | 2012-206093 | A | 10/2012 |
| JP | 2013-071441 | A | 4/2013 |
| JP | 2013-144446 | A | 7/2013 |
| JP | 2013-166260 | A | 8/2013 |
| JP | 2013-208813 | A | 10/2013 |
| JP | 2016-124191 | A | 7/2016 |
| WO | 2015/199181 | A1 | 12/2015 |
| WO | 2016/031920 | A1 | 3/2016 |
| WO | 2016/114396 | A1 | 7/2016 |
| WO | 2016/152798 | A1 | 9/2016 |

* cited by examiner

LIQUID DISCHARGE HEAD, RECORDING APPARATUS USING THE SAME, AND RECORDING METHOD

TECHNICAL FIELD

The present disclosure relates to a liquid discharge head, a recording apparatus using the same, and a recording method.

BACKGROUND ART

In the related art, as a printing head, for example, a liquid discharge head that performs various types of printing by discharging a liquid onto a recording medium is known. In the liquid discharge head, for example, multiple discharge holes for discharging the liquid are disposed so as to expand two-dimensionally. Printing is performed by liquids discharged from the respective discharge holes landing side by side on the recording medium (refer to, for example, PTL 1).

CITATION LIST

Patent Literature

PTL 1: Japanese Unexamined Patent Application Publication No. 2009-143168

SUMMARY OF INVENTION

A liquid discharge head of the present disclosure includes: a flow path member having a plurality of pressurizing chambers, a first common flow path commonly connected to the plurality of pressurizing chambers, and a second common flow path commonly connected to the plurality of pressurizing chambers; and a pressurizing unit that pressurizes corresponding one of the pressurizing chambers, in which the first common flow path extends in a first direction and is open to an outside of the flow path member at both end portions, and the second common flow path extends in the first direction and is open to the outside of the flow path member at both end portions.

A liquid discharge head of the present disclosure includes: a flow path member having a plurality of pressurizing chambers, a first common flow path commonly connected to the plurality of pressurizing chambers, and a second common flow path commonly connected to the plurality of pressurizing chambers; and a pressurizing unit that pressurizes corresponding one of the pressurizing chambers, in which the first common flow path and the second common flow path are disposed along a first direction, the plurality of pressurizing chambers are disposed along the first common flow path and the second common flow path, the first common flow path is supplied a liquid from an outside of a disposition range, in which the plurality of pressurizing chambers is disposed, in the first direction and from an outside of the disposition range in a third direction opposite to the first direction, and the liquid is collected on the outside of the disposition range in the first direction and on the outside of the disposition range in the third direction in the second common flow path.

A recording apparatus of the present disclosure includes: the liquid discharge head; and a liquid supply tank that supplies a liquid to the liquid discharge head, in which a viscosity of the liquid stored in the liquid supply tank is 5 mPa·s or higher and 15 mPa·s or lower.

In addition, a recording apparatus of the present disclosure includes: the liquid discharge head; and a liquid supply tank that supplies a liquid to the liquid discharge head, in which the liquid supply tank includes a stirring unit that stirs the liquid.

Further, a recording apparatus of the present disclosure includes: the liquid discharge head; an imaging unit; and a control unit, in which the imaging unit captures a liquid discharged from the liquid discharge head or an image formed by the liquid that has landed on a recording medium, and the control unit changes print data to be sent to the liquid discharge head based on data captured by the imaging unit.

In addition, a recording apparatus of the present disclosure includes: the liquid discharge head; a head chamber in which the liquid discharge head is accommodated; and a control unit, in which the control unit controls at least one of temperature, humidity, and atmospheric pressure in the head chamber.

Further, a recording apparatus of the present disclosure includes: the liquid discharge head; and a movable unit that moves a position of a recording medium relative to the liquid discharge head.

A recording method of the present disclosure, to a liquid discharge head including a flow path member having a plurality of pressurizing chambers, a first common flow path commonly connected to the plurality of pressurizing chambers, and a second common flow path commonly connected to the plurality of pressurizing chambers, and a pressurizing unit that pressurizes corresponding one of the pressurizing chambers, in which the first common flow path and the second common flow path are disposed along a first direction, and the plurality of pressurizing chambers are disposed along the first common flow path and the second common flow path, the method includes supplying a liquid from both an outside of a disposition range, in which the plurality of pressurizing chambers is disposed, in the first direction and an outside of the disposition range in a third direction opposite to the first direction, in the first common flow path; discharging part of the liquid by driving the pressurizing unit; and collecting the liquid, which is not discharged, from both the outside of the disposition range in the first direction and from the outside of the disposition range in the third direction, in the second common flow path.

DESCRIPTION OF EMBODIMENTS

Figure 1A:
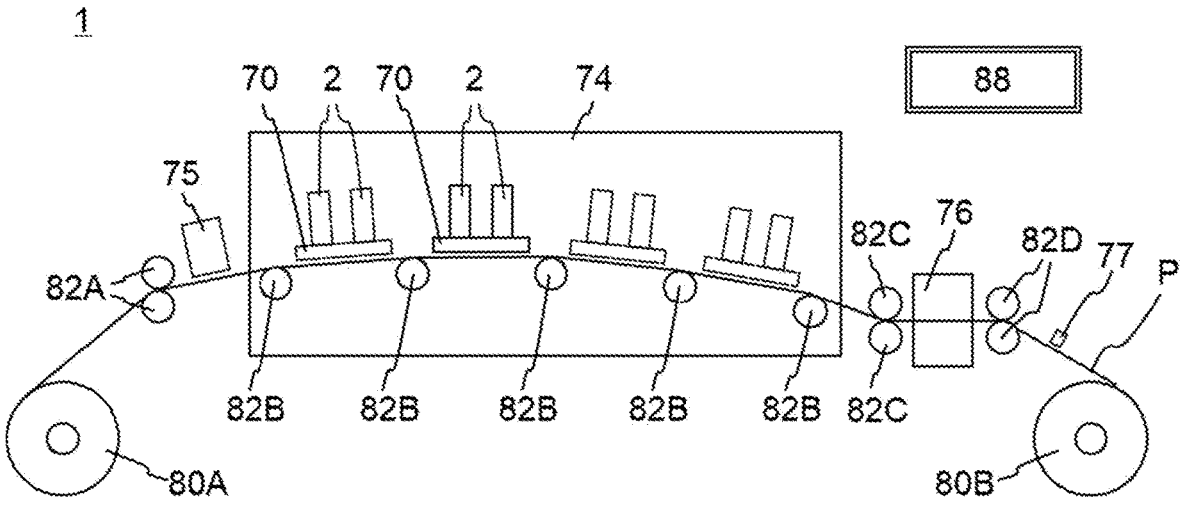
FIG. 1(*a*) is a side view of a recording apparatus including a liquid discharge head according to an embodiment of the present disclosure, and FIG. 1(*b*) is a plan view.
Figure 1B:
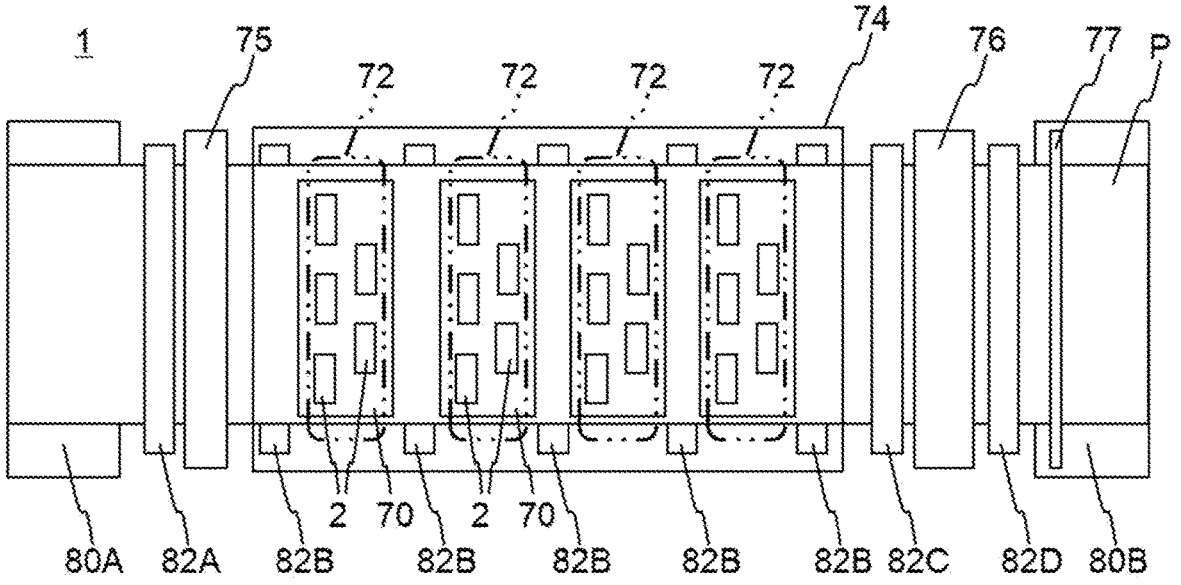

FIG. 1(*a*) is a schematic side view of a color ink jet printer 1 (hereinafter, may be simply referred to as a printer) that is a recording apparatus including a liquid discharge head 2 according to an embodiment of the present disclosure, and FIG. 1(*b*) is a schematic plan view. The printer 1 includes the liquid discharge head 2 that discharges a liquid and a movable unit that moves a recording medium relative to the liquid discharge head 2. In the printer 1, the movable unit is each of rollers, such as transport rollers 82A, 82B, 82C, and 82D, a motor that drives the rollers, and the like. The movable unit transports a printing paper sheet P which is a recording medium from the transport roller 82A to the transport roller 82B and the transport roller 82C. A control unit 88 controls the liquid discharge head 2 based on print data, such as data of images, characters, and the like, to discharge the liquid toward the printing paper sheet P, to make droplets land on the printing paper sheet P, and to perform recording, such as printing on the printing paper sheet P.

In the present embodiment, the liquid discharge head 2 is fixed to the printer 1, and the printer 1 is a so-called line printer. As another embodiment of the recording apparatus, a so-called serial printer may be employed that moves the liquid discharge head 2, for example, reciprocally in a direction that intersects with a transport direction of the printing paper sheet P, for example, in a substantially orthogonal direction, while alternately performing an operation of discharging the droplets and transport of the printing paper sheet P. In the serial printer, the movable unit includes a carriage on which the liquid discharge head 2 is mounted, and a motor that reciprocates the carriage in the direction that intersects with the transport direction of the printing paper sheet P. The movable unit may include a roller that transports the printing paper sheet P, a motor that drives the roller, and the like.

Four flat head-mounted frames 70 (hereinafter, may be simply referred to as frames) are fixed to the printer 1 substantially parallel to the printing paper sheet P. Each frame 70 has five holes (not illustrated), and the five liquid discharge heads 2 are mounted in the respective hole parts. The five liquid discharge heads 2 on one frame 70 configure one head group 72. The printer 1 has four head groups 72 and a total of 20 liquid discharge heads 2 are mounted.

The liquid discharge head 2 on the frame 70 is configured such that the part that discharges the liquid faces the printing paper sheet P. A distance between the liquid discharge head 2 and the printing paper sheet P is, for example, approximately 0.5 to 20 mm.

The 20 liquid discharge heads 2 may be directly connected to the control unit 88 or may be connected via a distribution unit that distributes the print data therebetween. For example, the distribution unit may distribute the print data sent from the control unit 88 to the 20 liquid discharge heads 2. Further, for example, by using four distribution units that correspond to the four head groups 72, each distribution unit may distribute the print data sent from the control unit 88 to the four distribution units, to the five liquid discharge heads 2 in the corresponding head group 72. The liquid discharge head 2 has a long shape elongated in a direction from a near side to a far side in FIG. 1(*a*) and in an up-down direction in FIG. 1(*b*). Within the one head group 72, the three liquid discharge heads 2 are arranged along a direction that intersects with the transport direction of the printing paper sheet P, for example, in the substantially orthogonal direction, and the other two liquid discharge heads 2 are respectively arranged one by one between the three liquid discharge heads 2 at a position shifted along the transport direction. In other words, in one head group 72, the liquid discharge heads 2 are disposed in a zigzag manner. The liquid discharge heads 2 are disposed such that printable ranges of the respective liquid discharge heads 2 are connected to each other in a width direction of the printing paper sheet P, that is, in the direction that intersects with the transport direction of the printing paper sheet P, or such that the ends overlap each other, and the printing is enabled without gaps in the width direction of the printing paper sheet P.

The four head groups 72 are disposed along the transport direction of the printing paper sheet P. A liquid, for example, ink is supplied to each of the liquid discharge heads 2 from a liquid supply tank (not illustrated). The liquid discharge heads 2 that belong to one head group 72 are supplied with ink having the same color, and the four head groups 72 enables printing with four colors of the ink. The colors of ink discharged from the respective head groups 72 are, for example, magenta (M), yellow (Y), cyan (C), and black (K). A color image can be printed by printing with such ink under the control of the control unit 88.

The number of liquid discharge heads 2 on the printer 1 may be one as long as printing is performed on the printable range of one liquid discharge head 2 in a single color. The number of liquid discharge heads 2 included in the head group 72 and the number of head groups 72 can be appropriately changed according to a printing target or printing conditions. For example, the number of head groups 72 may increase to perform multicolor printing. In addition, by disposing a plurality of head groups 72 that performs printing in the same color and alternately performs printing in the transport direction, the transport speed can increase even when the liquid discharge heads 2 having the same performance are used. Accordingly, a printing area per time can increase. In addition, the plurality of head groups 72 for printing in the same color may be prepared and disposed so as to be shifted in the direction that intersects with the transport direction, and the resolution of the printing paper sheet P in the width direction may increase.

Furthermore, in addition to the printing with the colored inks, a liquid, such as a coating agent, may be used to perform printing uniformly or in a patterned manner by the liquid discharge head 2 to perform surface treatment on the printing paper sheet P. As the coating agent, for example, when a medium into which the liquid does not easily penetrate is used as a recording medium, a coating agent that forms a liquid receiving layer can be used so that the liquid can be easily fixed. In addition, as a coating agent, when using a medium into which the liquid easily penetrates is used as a recording medium, a coating agent that forms a liquid infiltration suppressing layer can be used so that liquid bleeding does not become extremely large or the liquid does not mix with other liquid that has landed next to the liquid. The coating agent may be uniformly applied by an application unit 75 controlled by the control unit 88 alternatively to the printing by the liquid discharge head 2.

The printer 1 performs printing on the printing paper sheet P that is a recording medium. The printing paper sheet P is in a state of being wound around a paper feed roller 80A, and the printing paper sheet P sent out from the paper feed roller 80A passes under the liquid discharge head 2 on the frame 70, then passes between the two transport rollers 82C, and is finally collected by a collection roller 80B. When performing the printing, the printing paper sheet P is transported at a constant speed by rotating the transport roller 82C and subjected to printing by the liquid discharge head 2.

Next, the details of the printer 1 will be described in an order in which the printing paper sheet P is transported. The printing paper sheet P sent out from the paper feed roller 80A passes between the two transport rollers 82A and then passes under the application unit 75. The application unit 75 applies the above-described coating agent to the printing paper sheet P.

Subsequently, the printing paper sheet P enters a head chamber 74 accommodating the frame 7 on which the liquid discharge head 2 is mounted. The head chamber 74 is connected to the outside at a part, such as a part where the printing paper sheet P goes in and out, but is substantially a space isolated from the outside. In the head chamber 74, control factors, such as temperature, humidity, and atmospheric pressure, are controlled by the control unit 88 and the like as necessary. In the head chamber 74, the influence of disturbance can be reduced compared to the outside where the printer 1 is installed, and thus, a fluctuation range of the above-described control factors can be narrower than the outside.

Five transport rollers 82B are disposed in the head chamber 74, and the printing paper sheet P is transported on the transport rollers 82B. The five transport rollers 82B are disposed such that the center is convex in the direction in which the frames 70 are disposed when viewed from the side. Accordingly, the printing paper sheet P transported on the five transport rollers 82B has an arc shape when viewed from the side, and by applying tension to the printing paper sheet P, the printing paper sheet P between the respective transport rollers 82B is stretched to form a flat surface. One frame 70 is disposed between the two transport rollers 82B. An angle at which each frame 70 is installed changes little by little so as to be parallel to the printing paper sheet P transported under the frame 70.

The printing paper sheet P that has gone out of the head chamber 74 passes between the two transport rollers 82C, passes through a drying unit 76, passes between the two transport rollers 82D, and is collected by the collection roller 80B. The transport speed of the printing paper sheet P is, for example, 100 to 200 m/min. Each roller may be controlled by the control unit 88 or may be manually operated by a person.

Drying in the drying unit 76 makes it difficult for the printing paper sheet P, which is wound up in an overlapping manner, to adhere to each other in the collection roller 80B or to be rubbed with undried liquid. To perform the printing at high speed, it is also necessary to perform the drying quickly. To speed up the drying, the drying unit 76 may sequentially perform the drying by a plurality of drying methods, or may perform the drying by using a plurality of drying methods in combination. Examples of the drying method used in such drying include blowing warm air, emitting infrared rays, and contacting a heated roller. When emitting infrared rays, infrared rays in a specific frequency range may be applied such that drying can be performed quickly while reducing damage to the printing paper sheet P. When the printing paper sheet P is brought into contact with the heated roller, the time during which heat is transmitted may be lengthened by transporting the printing paper sheet P along a cylindrical surface of the roller. The range to be transported is preferably ¼ or more, and more preferably ½ or more. When printing with UV curable ink or the like, a UV irradiation light source may be disposed instead of the drying unit 76 or in addition to the drying unit 76. The UV irradiation light source may be disposed between the respective frames 70.

The printing paper sheet P obtained by drying or curing the printed liquid so as to be collected by the collection roller 80B is captured by an imaging unit 77, and the printing state is confirmed. The confirmation of the printing state may be performed by printing a test pattern or printing target print data to be printed. Imaging may be performed while transporting the printing paper sheet P, that is, while printing other parts of the printing paper sheet P, or may be performed while transporting is stopped.

The captured image data is evaluated by the control unit 88 as to whether or not there is a part at which printing is not successfully completed or that has poor printing accuracy. Specifically, it is evaluated whether there are no unprinted pixels since no droplets has been discharged, or whether the discharge amount, the discharge speed, and the discharge direction of the discharged liquid are shifted from the target, the landing position is shifted as the liquid is affected by a gas flow or the like while flying, or the spread of pixels after the landing is not reduced or increased.

When the control unit 88 detects a shift or the like equal to or greater than a set threshold value in the image data, the control unit 88 may notify the result. Further, when printing is in progress, the printing may be stopped or printing planned to be resumed may not be resumed.

Further, the control unit 88 may modify the print data so as to correct the shift detected in the image data, and cause the droplets to be discharged from the liquid discharge head 2 based on the modified print data. Specifically, when there is a pixel not printed, the control unit 88 creates print data in which the amount of liquid that lands around the pixel has increased relative to the original print data, and may drive the liquid discharge head 2 with the modified print data. Similarly, when the pixel density is high or the pixel size is large, print data in which the amount of liquid that lands around the pixel is reduced may be created. When the landing position is shifted in a certain direction, print data in which the amount of liquid that lands in a shift direction is reduced and the amount of liquid that lands in a direction opposite to the shift direction increases may be created. The range in which the print data is modified may be not only a range including the pixel adjacent to the pixel where the shift is detected, but also a wider range.

The printer 1 may include a cleaning unit that cleans the liquid discharge head 2. The cleaning unit performs cleaning by wiping or capping, for example. In wiping, for example, a flexible wiper is used to remove the liquid that adheres to the surface by rubbing the surface where the liquid is discharged, for example, a nozzle surface 4-2 described later. The capping cleaning is performed as follows, for example. By covering the part where the liquid is discharged, for example, the nozzle surface 4-2 described later, with a cap (this is referred to as capping), the part is almost sealed with the nozzle surface 4-2 and the cap and a space is created. In such a state, by repeating the discharge of the liquid, the liquid having a higher viscosity than the standard state, foreign matter, and the like, which are clogged in the discharge hole 8, are removed. By capping, it is difficult for the liquid in the cleaning to scatter to the printer 1, and to adhere to a transport mechanism, such as the roller, or the printing paper sheet P. The nozzle surface 4-2 that has been cleaned may be further wiped. Wiping or cleaning with capping may be performed manually by a person operating a wiper or a cap attached to the printer 1 or automatically by the control unit 88.

The recording medium may be a roll-like cloth other than the printing paper sheet P. Further, the printer 1 may directly transport a transport belt instead of directly transporting the printing paper sheet P, and transport the recording medium placed on the transport belt. By doing so, cut-sheet paper, cut cloth, wood, tiles and the like can be used as the recording medium. Furthermore, a wiring pattern of an electronic device may be printed by discharging a liquid containing conductive particles from the liquid discharge head 2. Furthermore, a chemical may be produced by discharging a predetermined amount of liquid chemical agent or liquid containing a chemical agent from the liquid discharge head 2 toward a reaction container or the like and by making the liquid react.

In addition, a position sensor, a speed sensor, a temperature sensor, and the like may be attached to the printer 1, and the control unit 88 may control each part of the printer 1 in accordance with the state of each part of the printer 1 understood from information from each sensor. For example, when the temperature of the liquid discharge head 2, the temperature of the liquid in the liquid supply tank that supplies the liquid to the liquid discharge head 2, the pressure applied by the liquid in the liquid supply tank to the liquid discharge head 2, and the like, give influence to the discharge characteristics of the liquid to be discharged, that is, the discharge amount or the discharge speed, or the like, a driving signal for discharging the liquid may be changed corresponding to the information.

Figure 2A:
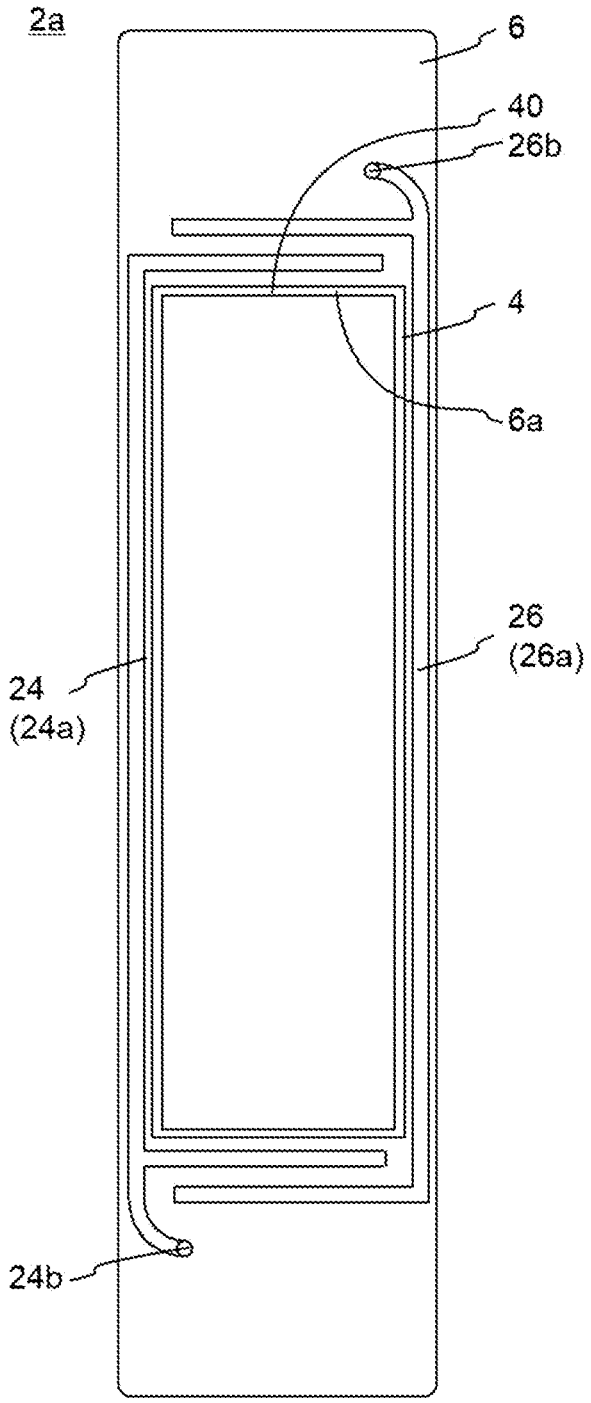
FIG. 2(*a*) is a plan view of a head main body that is a main part of the liquid discharge head of FIG. 1, and FIG. 2(*b*) is a plan view in which a second flow path member is removed from FIG. 2(*a*).
Figure 2B:
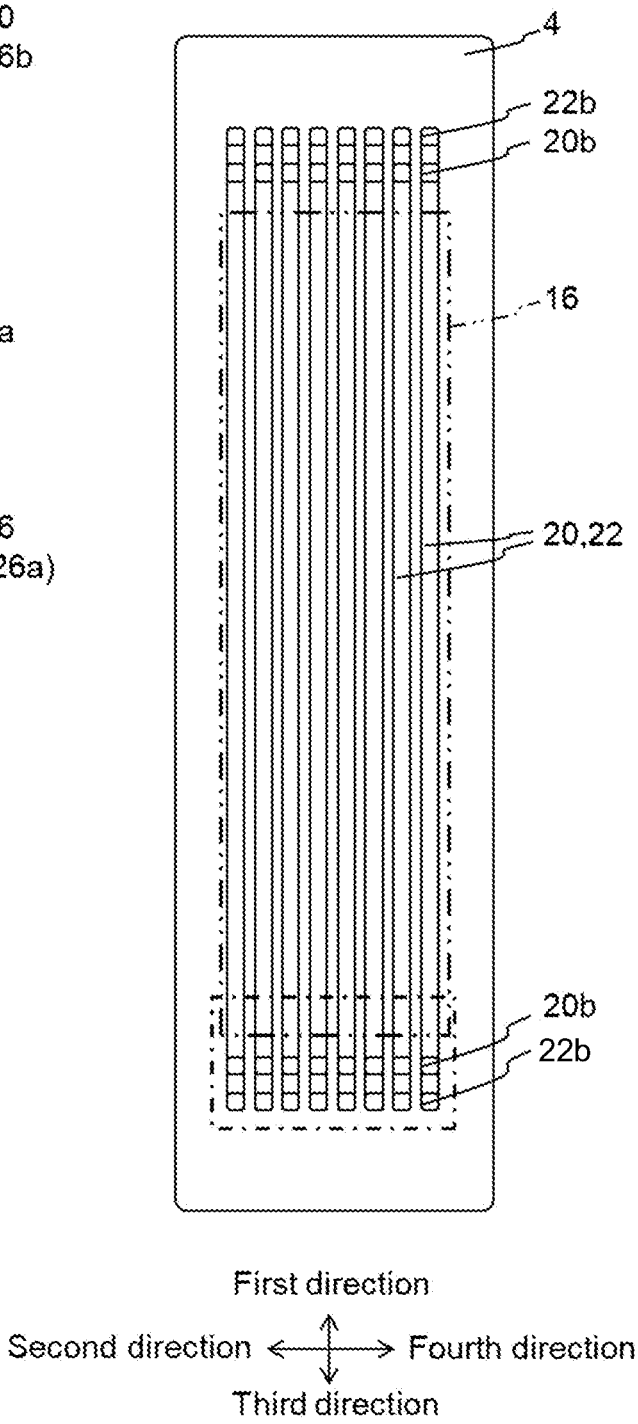
Figure 3:
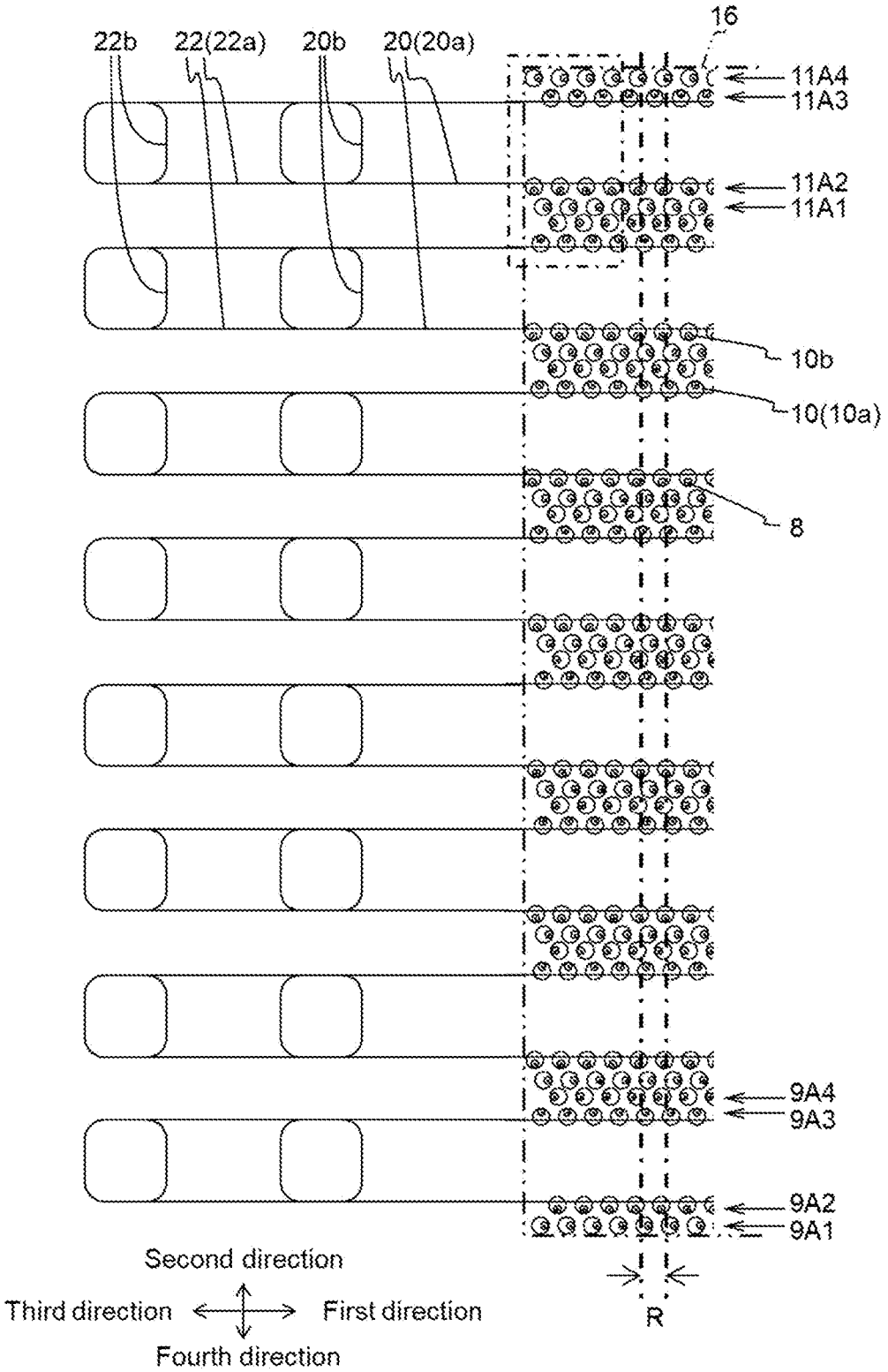
FIG. 3 is an enlarged plan view of a part of FIG. 2(*b*).
Figure 4:
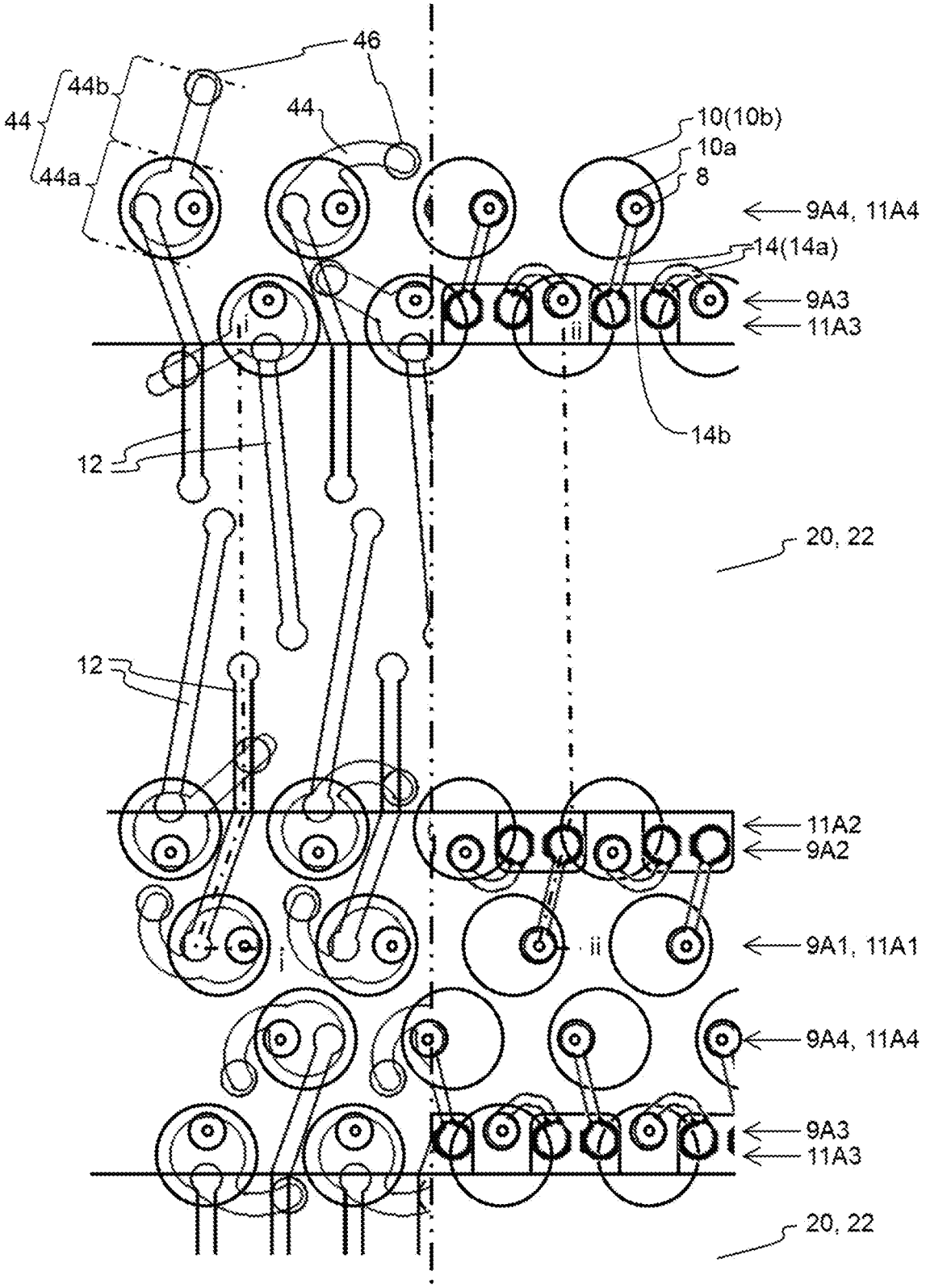
FIG. 4 is an enlarged plan view of a part of FIG. 2(*b*).

Next, the liquid discharge head 2 according to the embodiment of the present disclosure will be described. FIG. 2(*a*) is a plan view illustrating a head main body 2*a* which is a main part of the liquid discharge head 2 illustrated in FIG. 1. FIG. 2(*b*) is a plan view of a state where a second flow path member 6 is removed from the head main body 2*a*. FIG. 3 is an enlarged plan view of the head main body 2*a* in the range of one-dot chain line in FIG. 2(*b*). FIG. 4 is an enlarged plan view of the head main body 2*a* in the range of one-dot chain line in FIG. 3. In FIG. 4, a second individual flow path 14 is omitted on the left side of a two-dot chain line at the center that divides the drawing into left and right, and a first individual flow path 12, an individual electrode 44, and a connection electrode 46 are omitted on the right side of the two-dot chain line.

Figure 5A:
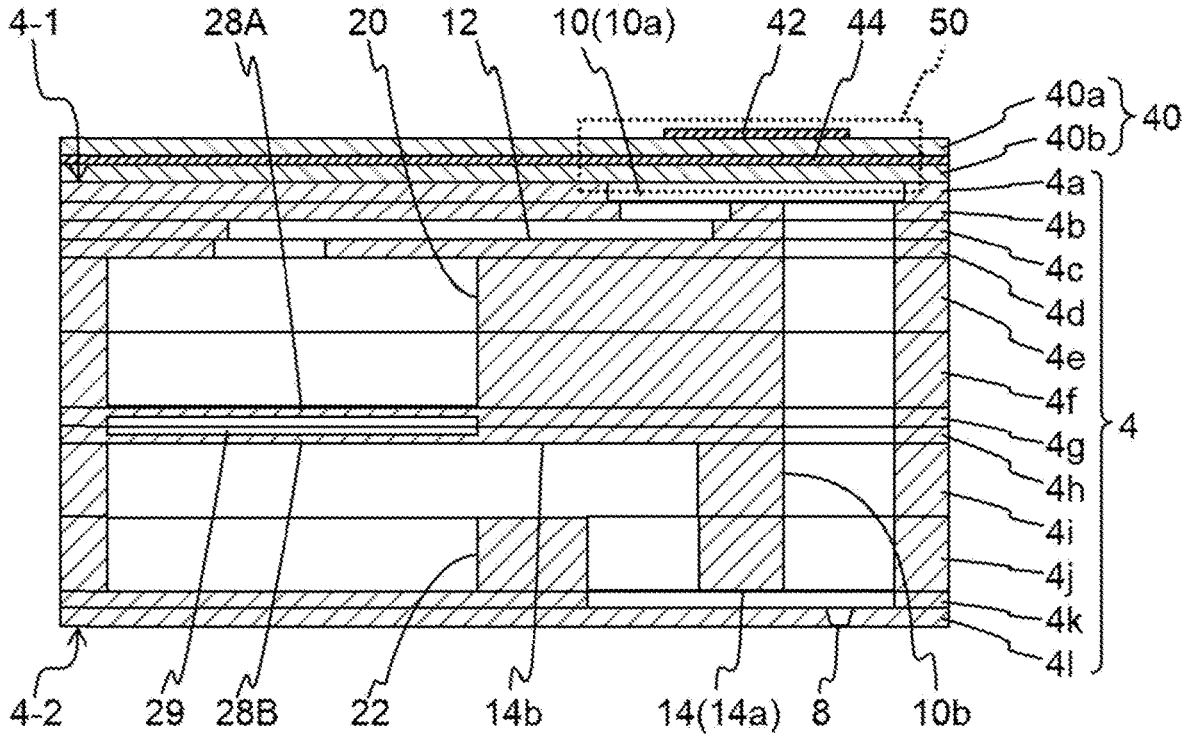
FIG. 5(*a*) is a schematic partial longitudinal sectional view of the head main body, and FIG. 5(*b*) is a longitudinal sectional view of another part of the head main body.
Figure 5B:
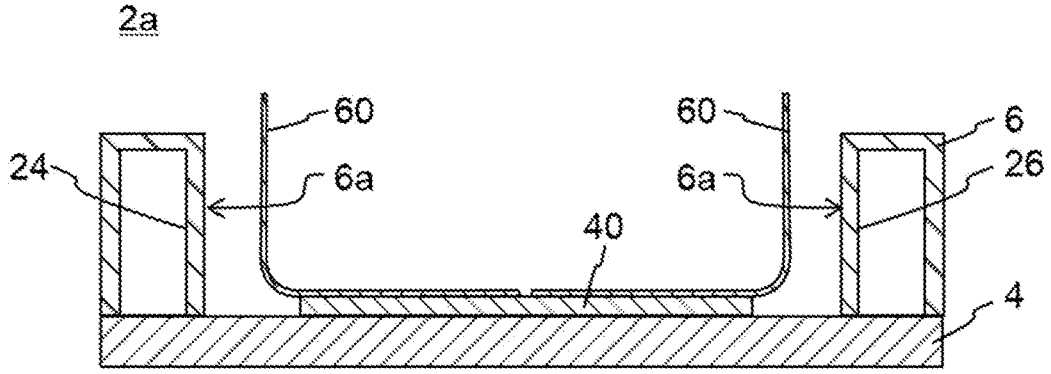

FIG. 5(*a*) is a schematic partial longitudinal sectional view of the head main body 2*a*. In FIG. 5(*a*), to make it easy to understand the state where the flow paths are connected to each other, the flow paths that do not actually exist on one vertical surface are drawn assuming that the flow paths exist on one vertical surface. Specifically, the upper side from a plate 4*g* is a section along a bent line i-i illustrated in FIG. 4, and the lower side from a plate 4*h* is a section along a bent line ii-ii illustrated in FIG. 4.

FIG. 5(*b*) is a longitudinal sectional view of another part of the head main body 2*a*. However, FIG. 5(*b*) also draws a signal transmission unit 60 not drawn in FIG. 2(*a*). In addition, in FIG. 5(*b*), the flow path inside the second flow path member 6 is drawn, but the flow path inside a first flow path member 4 is omitted.

In addition, in FIGS. 2 to 4, to make the drawings easy to understand, the flow path and the like to be drawn with a broken line below other objects are drawn with a solid line. The liquid discharge head 2 may include a metal housing, a driver IC, a wiring board, and the like in addition to the head main body 2*a*. In addition, the head main body 2*a* includes the first flow path member 4, the second flow path member 6 that supplies a liquid to the first flow path member 4, and a piezoelectric actuator substrate 40 in which a displacement element 50 being a pressurizing unit is built. The head main body 2*a* has a flat plate shape that is long in one direction, and the direction may be referred to as a longitudinal direction. In addition, the second flow path member 6 serves as a support member that supports a structure of the head main body 2*a*, and the head main body 2*a* is fixed to the frame 70 at each of both end portions of the second flow path member 6 in the longitudinal direction.

The first flow path member 4 that configures the head main body 2*a* has a flat plate shape, and the thickness thereof is approximately 0.5 to 2 mm. In a pressurizing chamber surface 4-1, which is one surface of the first flow path member 4, multiple pressurizing chambers 10 are disposed side by side in a plane view direction. Multiple discharge holes 8 through which the liquid is discharged are disposed side by side in the plane view direction on the discharge hole surface 4-2 opposite to the pressurizing chamber surface 4-1 in the first flow path member 4. The discharge holes 8 are respectively connected to the pressurizing chamber 10. In the following description, the pressurizing chamber surface 4-1 is assumed to be positioned above the discharge hole surface 4-2.

In the first flow path member 4, a plurality of first common flow paths 20 and a plurality of second common flow paths 22 are disposed so as to extend along the first direction. Hereinafter, the first common flow path 20 and the second common flow path 22 may be collectively referred to as a common flow path. The first common flow path 20 and the second common flow path 22 are disposed so as to overlap each other. A direction in which the first common flow path 20 and the second common flow path 22 are arranged, and that intersects with the first direction is defined as a second direction. In addition, the first direction is the same direction as the longitudinal direction of the head main body 2*a*. Further, a direction opposite to the first direction is defined as a third direction, and a direction opposite to the second direction is defined as a fourth direction.

The pressurizing chambers 10 connected to the first common flow path 20 and the second common flow path 22 are arranged along both sides of the first common flow path 20 and the second common flow path 22, each side has two rows, and a total of four pressurizing chamber rows 11A are formed. Four pressurizing chamber rows 11A connected to the first common flow path 20 and the second common flow path 22 are sequentially called a first pressurizing chamber row 11A1, a second pressurizing chamber row 11A2, a third pressurizing chamber row 11A3, and a fourth pressurizing chamber row 11A4, in the second direction. The pressurizing chamber 10 that belongs to the first pressurizing chamber row 11A1 may be referred to as a first pressurizing chamber, and the second to fourth pressurizing chambers are also used in the same meaning.

The first common flow path 20 and the four pressurizing chamber rows 10 arranged on both sides thereof are connected to each other via the first individual flow paths 12. The second common flow path 22 and the four pressurizing chamber rows 10 arranged on both sides thereof are connected to each other via the second individual flow paths 14.

With the configuration described above, in the first flow path member 4, the liquid supplied to the first common flow path 20 flows into the pressurizing chambers 10 arranged along the first common flow path 20, part of the liquid is discharged from the discharge hole 8, and other part of the liquid flows into the second common flow path 22 disposed so as to overlap the first common flow path 20 and is discharged from the first flow path member 4 to the outside.

The first common flow path 20 is disposed so as to overlap the second common flow path. The first common flow path 20 is open to the outside of the first flow path member 4 at openings 20*b* disposed in both an end portion in the first direction and an end portion in the third direction, on the outside of the range where the first individual flow paths are connected. The second common flow path 22 is open to the outside of the first flow path member 4 at openings 22*b* disposed in both an end portion in the first direction and an end portion in the third direction, on the outside of the range where the second individual flow paths are connected and on the outside of the openings 20*b* of the first common flow path 20. Since the opening 22*b* of the second common flow path 22 on the lower side is disposed on the outside of the opening 20*b* of the first common flow path 20 on the upper side, the space efficiency is improved.

From the opening 20*a* of the first common flow path 20 on the first direction side and the opening 20*a* on the third direction side, the liquid is supplied substantially at the same amount, and flows toward the center of the first common flow path 20. When the discharge amount of the liquid from the discharge holes 8 connected to one first common flow path 20 and the second common flow path 22 is substantially constant regardless of the place, the flow in the first common flow path 20 becomes slower as approaching the center, and becomes 0 (zero) substantially at the center. The flow in the second common flow path 22 is opposite thereto, and is almost 0 (zero) at the center, and the flow becomes faster as approaching the outside.

Since various things are recorded by the liquid discharge head 2, the discharge amount of the liquid from the discharge holes 8 connected to one first common flow path 20 and the second common flow path 22 has various distributions. When the discharge amount from the discharge hole 8 on the first direction side is large, the place where the flow becomes 0 (zero) is closer to the first direction side than the center. Conversely, when the discharge amount from the discharge hole 8 on the third direction side is large, the place where the flow becomes 0 (zero) is closer to the third direction side than the center. In this manner, the place where the flow becomes 0 (zero) moves as the distribution of the discharge changes depending on what is recorded. Accordingly, even when the flow becomes 0 (zero) and the liquid stays at a certain moment, the staying at the place is eliminated since the distribution of the discharge changes, and thus, the liquid keeps staying at the same place, and accordingly, sedimentation of the pigment or sticking of the liquid may be less likely to occur.

The pressure applied to the part of the first individual flow path 12 on the first common flow path 20 side connected to the first common flow path 20 is affected by a pressure loss, and changes depending on the position (mainly, the position in the first direction) where the first individual flow path 12 is connected to the first common flow path 20. The pressure applied to the part on the second common flow path 14 side connected to the second common flow path 22 is affected by a pressure loss, and changes depending on the position (mainly, the position in the first direction) where the second individual flow path 14 is connected to the second common flow path 22. When the pressure of the liquid in one discharge hole 8 is set to approximately 0 (zero), the above-described pressure change changes symmetrically, and thus, the liquid pressure in all of the discharge holes 8 can be set to approximately 0 (zero).

In such a configuration, when the viscosity of the liquid is 5 mPa·s or higher and 15 mPa·s or lower, the staying of the liquid may be less likely to occur. Furthermore, when the liquid supply tank for supplying the liquid to be discharged includes the stirring unit that stirs the liquid, the properties of the liquid supplied to the liquid discharge head 2 is stabilized, and thus the liquid can be more unlikely to stay.

In the above description, the openings 20*b* of the first common flow path 20 are disposed in the end portion in the first direction and the end portion in the third direction, but the two openings 20*b* may be disposed on the outside of the pressurizing chamber disposition range 16, in which the pressurizing chambers 10 are disposed, in the first direction and the third direction. Similarly, the two openings 22*b* of the second common flow path 22 may be disposed on the outside of the pressurizing chamber disposition range 16, where the pressurizing chambers 10 are disposed, in the first direction and the third direction. In addition, the pressurizing chamber disposition range 16 is a convex polygonal range that includes all of the pressurizing chambers 10 when viewed in plan view.

In addition, the two openings 20*b* of the first common flow path 20 may be disposed on the outside of a connection range where the pressurizing chambers 10 connected to that first common flow path 20 are connected in the first direction and the third direction. Note that, the connection range where the pressurizing chambers 10 are connected is specifically a range in which a connection portion of the first individual flow path 12 on the first common flow path 20 side, that is, a flow path that connects the pressurizing chamber 10 and the first common flow path 20 to each other, is disposed in the first common flow path 20. The two openings 22*b* of the second common flow path 22 may be disposed on the outside of a connection range where the pressurizing chamber 10 connected to that second common flow path 22 are connected in the first direction and the third direction. The lower surface of the first common flow path 20 is a damper 28A. The surface of the damper 28A opposite to the surface that faces the first common flow path 20 faces a damper chamber 29. The damper chamber 29 contains a gas, such as air, and the volume thereof changes depending on the pressure applied from the first common flow path 20. The damper 28A can vibrate when the volume of the damper chamber 29 changes, and the pressure fluctuation generated in the first common flow path 20 can be attenuated by attenuating the vibration. By including the damper 28A, pressure fluctuations, such as resonance of the liquid in the first common flow path 20, can be reduced.

The upper surface of the second common flow path 22 is a damper 28B. The surface of the damper 28B opposite to the surface that faces the second common flow path 22 faces the damper chamber 29. Similar to the case of the first common flow path, by including the damper 28B, pressure fluctuations, such as resonance of the liquid in the second common flow path 22, can be reduced. By including one damper chamber 29, both the damper 28A and the damper 28B can function as dampers, and thus, the space utilization efficiency of the first flow path member 4 can increase and the head main body 2*a* can be reduced.

In the present embodiment, respectively, there are eight first common flow paths 20 and eight second common flow paths 22. The pressurizing chamber 10 connected to each common flow path configures two pressurizing chamber rows 11A on one side and four pressurizing chamber rows 11A on both sides in the common flow path. Therefore, there are 32 pressurizing chamber rows 11A in total.

Four pressurizing chamber rows 11A connected to one first common flow path 20 and one second common flow path 22 are sequentially referred to as the first pressurizing chamber row 11A1, the second pressurizing chamber row 11A2, the third pressurizing chamber row 11A3, and the fourth pressurizing chamber row 11A4, in the second direction. Further, the pressurizing chambers 10 that belong to the respective pressurizing chamber rows are referred to as first to fourth pressurizing chambers in order.

The discharge holes 8 configure discharge hole rows 9A that correspond to the respective pressurizing chamber rows 11A, and there are 32 discharge hole rows 9A in total. In each of the discharge hole rows 9A, the discharge holes 8 are disposed at an interval of 50 dpi (approximately 25.4 mm/50). There are 32 discharge hole rows disposed so as to be shifted from each other, and accordingly, the discharge holes 8 are disposed at an interval of 1600 dpi as a whole.

More specifically, in FIG. 3, when the discharge holes 8 are projected in a direction orthogonal to the first direction, 32 discharge holes 8 are projected in the range of a virtual straight line R, and the respective discharge holes 8 within the virtual straight line R are arranged at an interval of 1200 dpi. Accordingly, when the printing paper sheet P is transported and subjected to printing in a direction orthogonal to the virtual straight line R, printing can be performed with a resolution of 120 dpi.

The second flow path member 6 is joined to the pressurizing chamber surface 4-1 of the first flow path member 4, and has a first integrated flow path 24 for supplying the liquid to the first common flow path 20 and a second integrated flow path 26 for collecting the liquid of the second common flow path 22. The thickness of the second flow path member 6 is larger than that of the first flow path member 4 and is approximately 5 to 30 mm.

The second flow path member 6 is joined in a region, where a piezoelectric actuator substrate 40 is not connected, on the pressurizing chamber surface 4-1 of the first flow path member 4. More specifically, the second flow path member 6 is joined to surround the piezoelectric actuator substrate 40. In this manner, adhesion of part of the discharged liquid to the piezoelectric actuator substrate 40 as mist may be suppressed. Further, since the first flow path member 4 is fixed on the outer periphery, it is possible to suppress vibration of the first flow path member 4 caused by the driving of the displacement element 50 and generation of resonance or the like.

An opening 24*b* open to the upper surface of the second flow path member 6 is disposed in the end portion of the first integrated flow path 24 in the third direction. The first integrated flow path 24 is branched into two in the middle, one is connected to the opening 20*b* of the first common flow path 20 on the third direction side, and the other one is connected to the opening 20*b* of the first common flow path 20 on the first direction side. An opening 26*b* open to the upper surface of the second flow path member 6 is disposed in the end portion of the second integrated flow path 26 in the first direction. The second integrated flow path 26 is branched into two in the middle, one is connected to the opening 22*b* of the second common flow path 22 on the first direction side, and the other one is connected to the opening 22*b* of the first common flow path 22 on the third direction side. When printing is performed, the liquid is supplied from the outside to the opening 24*b* of the first integrated flow path 24, and the liquid that has not been discharged is collected from the opening 26*b* of the second integrated flow path 26.

Note that, the collected liquid may be returned to the liquid supply tank that supplies the liquid to the liquid discharge head 2 or may be stored in the liquid collection tank. The liquid that stays in the liquid collection tank can be used for printing after passing through a filter or adjusting the viscosity as necessary.

Further, the second flow path member 6 has a through hole 6*a* that penetrates the second flow path member 6 in an up-down direction. A signal transmission unit, such as a flexible printed circuit (FPC) that transmits a driving signal for driving the piezoelectric actuator substrate 40 is passed through the through hole 6*a*.

By disposing the first integrated flow path 24 in the second flow path member 6 different from the first flow path member 4 and thicker than the first flow path member 4, a sectional area of the first integrated flow path 24 can increase, and accordingly, a difference in pressure loss due to a difference in position where the first integrated flow path 24 and the first common flow path 20 are connected to each other can be reduced. The flow path resistance of the first integrated flow path 24 is preferably set to 1/100 or less of that of the first common flow path 20. Here, the flow path resistance of the first integrated flow path 24 is more precisely the flow path resistance of the first integrated flow path 24 in a range where the first integrated flow path 24 is connected to the first common flow path 20.

By disposing the second integrated flow path 26 in the second flow path member 6 different from the first flow path member 4 and thicker than the first flow path member 4, a sectional area of the second integrated flow path 26 can increase, and accordingly, a difference in pressure loss due to a difference in position where the second integrated flow path 26 and the second common flow path 22 are connected to each other can be reduced. The flow path resistance of the second integrated flow path 26 is preferably set to 1/100 or less of that of the second common flow path 22. Here, the flow path resistance of the second integrated flow path 26 is more precisely the flow path resistance of the second integrated flow path 26 in a range where the second integrated flow path 26 is connected to the first integrated flow path 24.

The first integrated flow path 24 is disposed at one end of the second flow path member 6 in a short direction, the second integrated flow path 26 is disposed at the other end of the second flow path member 6 in the short direction, each of the flow paths is directed to the first flow path member 4 side so as to be connected to the first common flow path 20 and the second common flow path 22. With such a structure, the sectional areas of the first integrated flow path 24 and the second integrated flow path 26 can increase, and the flow path resistances can be reduced. With such a structure, since the outer periphery is fixed by the second flow path member 6, the first flow path member 4 can make rigidity high. Furthermore, with such a structure, the through hole 6*a* through which the signal transmission unit 60 passes can be included.

On the lower surface of the second flow path member 6, a groove that becomes the first integrated flow path 24 and a groove that becomes the second integrated flow path 26 are disposed. The groove that becomes the first integrated flow path 22 of the second flow path member 6 is connected to the opening 20*a* of the first common flow path 20 in which a part of the lower surface is closed by the upper surface of the flow path member 4 and the other part of the lower surface is disposed on the upper surface of the flow path member 4, and accordingly, the first integrated flow path 22 is constituted. The groove that becomes the second integrated flow path 26 of the second flow path member 6 is connected to the opening 22*a* of the second common flow path 22 in which a part of the lower surface is closed by the upper surface of the flow path member 4 and the other part of the lower surface is disposed on the upper surface of the flow path member 4, and accordingly, the second integrated flow path 26 is constituted.

A damper may be included in each of the first integrated flow path 24 and the second integrated flow path 26 and the supply or discharge of the liquid may be stabilized against fluctuations in the discharge amount of the liquid. Further, by including a filter inside the first integrated flow path 24 or the second integrated flow path 26 or between the first common flow path 20 and the second common flow path 22, foreign matters or bubbles may be difficult to enter the first flow path member 4.

The piezoelectric actuator substrate 40 including the displacement element 50 is joined to the pressurizing chamber surface 4-1 which is the upper surface of the first flow path member 4, and each of the displacement elements 50 is disposed on the pressurizing chamber 10. The piezoelectric actuator substrate 40 occupies a region having substantially the same shape as the pressurizing chamber group constituted by the pressurizing chambers 10. Further, the openings of the respective pressurizing chambers 10 are closed by joining the piezoelectric actuator substrate 40 to the pressurizing chamber surface 4-1 of the flow path member 4. The piezoelectric actuator substrate 40 has a rectangular shape that is long in the same direction as the head main body 2*a*. In addition, the piezoelectric actuator substrate 40 is connected to the signal transmission unit 60, such as an FPC for supplying a signal to each of the displacement elements 50. The second flow path member 6 has a through hole 6*a* that penetrates the second flow path member 6 at the center in the up-down direction, and the signal transmission unit 60 is electrically connected to the control unit 88 through the through hole 6*a*. The signal transmission unit 60 has a shape that extends in the short direction from one end of a long side of the piezoelectric actuator substrate 40 toward the other end of the long side, and when the wires in the signal transmission unit extend along the short direction and are arranged in the longitudinal direction, the distance between the wires can increase.

Individual electrodes 44 are disposed at positions opposing the respective pressurizing chambers 10 on the upper surface of the piezoelectric actuator substrate 40.

The flow path member 4 has a laminated structure in which a plurality of plates is laminated. A plate 4*a* is disposed on the pressurizing chamber surface 4-1 side of the flow path member 4, and plates 4*b* to 4*l* are sequentially laminated under the plate 4*a*. In addition, the plate 4*a* in which the hole as the side wall of the pressurizing chamber 10 is included may be called the cavity plate 4*a*, and the plates 4*e, f, i*, and *j* in which the hole as the side wall of the common flow path is included may be called the manifold plates 4*e, f, i*, and *j*, and the plate 4*l* in which the discharge holes 8 are open may be called the nozzle plate 4*l*. Each plate has multiple holes or grooves. For example, the holes or grooves can be formed by etching each plate made of metal. Since the thickness of each plate is approximately 10 to 300 μm, the formation accuracy of the holes to be formed can be increase. The respective plates are aligned and stacked such that the holes communicate with each other to constitute a flow path, such as the first common flow path 20.

A pressurizing chamber main body 10*a* is open on the pressurizing chamber surface 4-1 of the flat flow path member 4, and the piezoelectric actuator substrate 40 is joined thereto. In addition, the pressurizing chamber surface 4-1 has an opening 20*a* for supplying the liquid to the first common flow path 20 and an opening 24*a* for collecting the liquid from the second common flow path 22. The discharge hole 8 is open on the discharge hole surface 4-2 opposite to the pressurizing chamber surface 4-1 of the flow path member 4.

As a structure for discharging the liquid, there are the pressurizing chamber 10 and the discharge hole 8. The pressurizing chamber 10 includes the pressurizing chamber main body 10*a* that faces the displacement element 50 and a descender 10*b* having a smaller sectional area than that of the pressurizing chamber main body 10*a*. The pressurizing chamber main body 10*a* is configured such that the upper side of the hole in the cavity plate 4*a* is closed with the piezoelectric actuator substrate 40, and the part of the lower side other than the descender 10*b* is closed with the plate 4*b*. The descender 10*b* is formed by overlapping the holes on the plates 4*b* to 4*k*, and by further covering the part of the lower side other than the discharge holes 8 with the nozzle plate 4*l*. The upper side of the descender 10*b* is connected to the pressurizing chamber main body 10*a*.

The first individual flow path 12 is connected to the pressurizing chamber main body 10*a*, and the first individual flow path 12 is connected to the first common flow path 20. The first individual flow path 12 includes a circular hole that penetrates the plate 4*b*, an elongated penetrating groove that extends in the plane direction of the plate 4*c*, and a circular hole that penetrates the plate 4*d*.

The second individual flow path 14 is connected to the descender 10*b*, and the second individual flow path 14 is connected to the second common flow path 22. The second individual flow path 14 includes: a first part 14*a* having an elongated penetrating groove that is connected from a circular hole serving as the partial flow path 10*b* of the plate 4*k* and extends in the plane direction, and a circular hole that penetrates the plate 4*j*; and a second part 14*b* which is a rectangular hole that penetrates the plate 4*i* and is connected to a penetrating groove that becomes the second common flow path 22. The second part 14*b* is shared with the second individual flow path 14 connected from another descender 10*b*, and the first parts 14*a* of the two second individual flow paths 14 are connected to the second common flow path 22 after being joined together at the second part 14*b* of the plate 4*i*.

The first common flow path 20 is formed by overlapping the holes in the plates 4*e* and *f*, and by further covering the upper side with the plate 4*d* and the lower side with the plate 4*g*. The second common flow path 22 is formed by overlapping holes in the plates 4*i* and *j*, and by further covering the upper side with the plate 4*h* and the lower side with the plate 4*k*.

Summarizing the flow of the liquid, the liquid supplied to the first integrated flow path 24 passes through the first common flow path 20 and the first individual flow path 12 in order, enters the pressurizing chamber 10, and part of the liquid is discharged from the discharge hole 8. The liquid that has not been discharged passes through the second individual flow path 14, enters the second common flow path 22, enters the second integrated flow path 26, and is discharged to the outside of the head main body 2*a*.

The piezoelectric actuator substrate 40 has a laminated structure configured with two piezoelectric ceramic layers 40*a* and 40*b* which are piezoelectric bodies. Each of the piezoelectric ceramic layers 40*a* and 40*b* has a thickness of approximately 20 μm. In other words, the thickness from the upper surface of the piezoelectric ceramic layer 40*a* to the lower surface of the piezoelectric ceramic layer 40*b* in the piezoelectric actuator substrate 40 is approximately 40 μm. The thickness ratio between the piezoelectric ceramic layer 40*a* and the piezoelectric ceramic layer 40*b* is set to 3:7 to 7:3, and preferably 4:6 to 6:4. Both of the piezoelectric ceramic layers 40*a* and 40*b* extend so as to straddle the plurality of pressurizing chambers 10. The piezoelectric ceramic layers 40*a* and 40*b* are made of, for example, a ceramic material, such as lead zirconate titanate (PZT), $NaNbO_3$, $BaTiO_3$, $(BiNa)NbO_3$, or $BiNaNb_5O_{15}$ having ferroelectricity.

The piezoelectric ceramic layer 40*b* does not have a structure sandwiched between electrodes and the like which will be described below. In other words, in the piezoelectric ceramic layer 40*b*, even when the driving signal is applied to the displacement element 50, spontaneous piezoelectric deformation is practically not performed, and the piezoelectric ceramic layer 40*b* functions as a diaphragm. Therefore, the piezoelectric ceramic layer 40*b* can be changed to other ceramic having no piezoelectricity or a metal plate. Further, a metal plate may be laminated under the piezoelectric ceramic layer 40*b*, and both the piezoelectric ceramic layer 40*b* and the metal plate may be used as a diaphragm. In addition, with such a structure, the metal plate can also be regarded as a part of the first flow path member 4. In such a configuration, since the piezoelectric ceramic layer 40*b* and the liquid are not in direct contact with each other, the reliability of the piezoelectric actuator substrate 40 can increase.

The piezoelectric actuator substrate 40 has a common electrode 42 made of a metal material, such as Ag—Pd, and the individual electrode 44 made of a metal material, such as Au. The thickness of the common electrode 42 is approximately 2 μm, and the thickness of the individual electrode 44 is approximately 1 μm.

The individual electrodes 44 are disposed at positions opposing the respective pressurizing chambers 10 on the upper surface of the piezoelectric actuator substrate 40. The individual electrode 44 includes: an individual electrode main body 44*a* having a shape in plan view that is slightly smaller than the pressurizing chamber main body 10*a* and having a shape substantially similar to the pressurizing chamber main body 10*a*; and an extraction electrode 44*b* extracted from the individual electrode main body 44*a*. The connection electrode 46 is formed at a part of one end of the extraction electrode 44*b* that is extracted to the outside of the region opposing the pressurizing chamber 10. The connection electrode 46 is a conductive resin that contains conductive particles, such as silver particles, and is formed with a thickness of approximately 5 to 200 μm. In addition, the connection electrode 46 is electrically joined to an electrode included in the signal transmission unit.

As will be described in detail later, the driving signal is supplied from the control unit 88 to the individual electrode 44 through the signal transmission unit. The driving signal is supplied in a constant cycle in synchronization with the transport speed of the printing medium P.

The common electrode 42 is formed over substantially the entire surface in a surface direction in the region between the piezoelectric ceramic layer 40*a* and the piezoelectric ceramic layer 40*b*. In other words, the common electrode 42 extends so as to cover all of the pressurizing chambers 10 in the region that opposes the piezoelectric actuator substrate 40. The common electrode 42 is connected to a surface electrode (not illustrated) for the common electrode at a position that avoids an electrode group configured with the individual electrodes 44 on the piezoelectric ceramic layer 40*a*, via a through conductor formed by penetrating the piezoelectric ceramic layer 40*a*. In addition, the common electrode 42 is grounded via the surface electrode for the common electrode, and is held at the ground potential. Similar to the individual electrode 44, the surface electrode for the common electrode is directly or indirectly connected to the control unit 88.

A part of the piezoelectric ceramic layer 40*a* sandwiched between the individual electrode 44 and the common electrode 42 is polarized in the thickness direction, and becomes the displacement element 50 having a unimorph structure and displaced when a voltage is applied to the individual electrode 44. More specifically, when an electric field is applied in a polarization direction to the piezoelectric ceramic layer 40*a* by setting the individual electrode 44 to a potential different from that of the common electrode 42, the part to which the electric field is applied functions as an active portion distorted by the piezoelectric effect. In this configuration, when the individual electrode 44 is set to a predetermined positive or negative potential with respect to the common electrode 42 by the control unit 88 such that the electric field and the polarization are in the same direction, a part (active portion) of the piezoelectric ceramic layer 40*a* sandwiched between the electrodes contracts in the surface direction. Meanwhile, since the piezoelectric ceramic layer 40*b*, which is an inactive layer, is not affected by the electric field, spontaneous contraction does not occur and deformation of the active portion is to be suppressed. As a result, a difference in strain in the polarization direction between the piezoelectric ceramic layer 40*a* and the piezoelectric ceramic layer 40*b*, and the piezoelectric ceramic layer 40*b* is deformed (unimorph deformation) so as to be convex toward the pressurizing chamber 10 side.

Next, a liquid discharge operation will be described. The displacement element 50 is driven (displaced) by the driving signal supplied to the individual electrode 44 via a driver IC or the like under the control of the control unit 88. In the present embodiment, the liquid can be discharged by various driving signals, but here, a so-called strike driving method will be described.

The individual electrode 44 is set to a potential (hereinafter, referred to as a high potential) higher than the common electrode 42 in advance, the individual electrode 44 is once set to the same potential (hereinafter, referred to as a low potential) as the common electrode 42 every time there is a discharge request, and thereafter, high potential is set again at a predetermined timing. Accordingly, at the timing when the individual electrode 44 becomes low potential, the piezoelectric ceramic layers 40*a* and 40*b* (start to) return to the original (flat) shape, and the volume of the pressurizing chamber 10 increases compared to that in an initial state (a state where the potentials of both electrodes are different). As a result, a negative pressure is applied to the liquid in the pressurizing chamber 10. Then, the liquid in the pressurizing chamber 10 starts to vibrate in an intrinsic vibration cycle. Specifically, first, the volume of the pressurizing chamber 10 starts to increase, and the negative pressure gradually decreases. Next, the volume of the pressurizing chamber 10 becomes maximum and the pressure becomes substantially zero. Then, the volume of the pressurizing chamber 10 starts to decrease, and the pressure increases. Thereafter, the individual electrode 44 is set to high potential at a timing at which the pressure becomes substantially maximum. Then, the first applied vibration overlaps the next applied vibration, and a larger pressure is applied to the liquid. The pressure is transmitted through the descender and causes the liquid to be discharged from the discharge hole 8.

In other words, droplets can be discharged by supplying a driving signal that is a low potential for a certain period with the high potential as a reference to the individual electrode 44. When the pulse width is an acoustic length (AL), which is half the time of the intrinsic vibration cycle of the liquid in the pressurizing chamber 10, in principle, the discharge speed and discharge amount of the liquid can be maximized. The intrinsic vibration cycle of the liquid in the pressurizing chamber 10 is greatly affected by the physical properties of the liquid and the shape of the pressurizing chamber 10 and also affected by the physical properties of the piezoelectric actuator substrate 40 or the characteristics of the flow path connected to pressurizing chamber 10.

In the present embodiment, the shape of the pressurizing chamber main body 10*a* is circular in plan view and has infinite rotational symmetry. The shape of the pressurizing chamber main body 10*a* may be a rotationally symmetric shape of a three-fold or more rotational symmetry in plan view. In addition, the opening of the first individual flow path 12 on the pressurizing chamber main body 10*a* side is disposed on the side opposite to the opening on the pressurizing chamber main body 10*a* side of the descender 10*b* with respect to the area center of gravity of the pressurizing chamber main body 10. More specifically, the opposite side means that the formed angle is 135 degrees or more.

In the second and third pressurizing chambers, the opening of the descender 10*b* on the pressurizing chamber main body 10*a* side is farther from the area center of gravity of the pressurizing chamber main body 10*a* than the first common flow path 20 and the first common flow path 22. Accordingly, the width of the first common flow path 20 and the second common flow path 22 can be enlarged, and the flow rate of the flowing liquid can increase.

The first individual flow path 12 is a part that reflects pressure waves, needs to have a high flow path resistance, and is formed into an elongated shape.

In the first pressurizing chamber, the position where the descender 10*b* and the first individual flow path 12 are connected to each other is a position rotated by 90 degrees with respect to the second pressurizing chamber. However, since the pressurizing chamber main body 10*a* has a rotational symmetry of 90 degrees, the outer shape of the pressurizing chamber main body 10*a* is in the same state as that when being moved in parallel without rotation. Accordingly, the difference in rigidity of the pressurizing chamber main body 10*a* is reduced, and the difference in discharge characteristics is less likely to occur.

The first individual flow path 12 extends from the pressurizing chamber main body 10*a* in the direction in which the first common flow path 20 and the second common flow path 22 exist. The first individual flow path 12 connected to the first pressurizing chamber and the first individual flow path 12 connected to the third pressurizing chamber extend toward each other. Since the position to which the first individual flow path 12 of the first pressurizing chamber is connected is a position rotated by 90 degrees compared to the second pressurizing chamber, the position of first individual flow path 12 connected to the first pressurizing chamber can be disposed on the second pressurizing chamber side compared to a case of being moved without rotation. Accordingly, the first individual flow path 12 connected with the first pressurizing chamber and the first individual flow path 12 connected with the third pressurizing chamber may be disposed so as not to overlap each other in the second direction.

The first individual flow path 12 connected to the fourth pressurizing chamber and the first individual flow path 12 connected to the second pressurizing chamber extend toward each other. Since the position to which the first individual flow path 12 of the fourth pressurizing chamber is connected is a position rotated by 90 degrees compared to the third pressurizing chamber, the position of first individual flow path 12 connected to the fourth pressurizing chamber can be disposed on the fourth pressurizing chamber side compared to a case of being moved without rotation. Accordingly, the first individual flow path 12 connected to the fourth pressurizing chamber and the first individual flow path 12 connected with the second pressurizing chamber may be disposed so as not to overlap each other in the second direction.

The state will be described with another expression. The first individual flow paths 12 connected to the first to fourth pressurizing chambers partially overlap a part of the first common flow path 20 and the second common flow path 22. In the first direction, a set of the first individual flow paths 12 connected to the first pressurizing chambers and the first individual flow paths 12 connected to the third pressurizing chambers, and a set of the first individual flow paths 12 connected to the second pressurizing chambers and the first individual flow paths 12 connected to the fourth pressurizing chambers, are disposed alternately. The opening of the first individual flow path 12 connected to the first pressurizing chamber on the first common flow path 20 side, and the opening of the first individual flow path 12 connected to the third pressurizing chamber on the first common flow path 20 side, can be disposed to be apart from each other in the second direction since the first and third pressurizing chambers are configured as described above. Similarly, the opening of the first individual flow path 12 connected to the second pressurizing chamber on the first common flow path 20 side, and the opening of the first individual flow path 12 connected to the fourth pressurizing chamber on the first common flow path 20 side, can be disposed to be apart from each other in the second direction since the second and fourth pressurizing chambers are configured as described above. Accordingly, the first individual flow path 12 connected to the first pressurizing chamber and the first individual flow path 12 connected with the third pressurizing chamber can be disposed substantially at the same position in the first direction. Similarly, the first individual flow path 12 connected to the second pressurizing chamber and the first individual flow path 12 connected with the fourth pressurizing chamber can be disposed substantially at the same position in the first direction. Accordingly, as described first, in the first direction, a set of the first individual flow paths 12 connected to the first pressurizing chambers and the first individual flow paths 12 connected to the third pressurizing chambers, and a set of the first individual flow paths 12 connected to the second pressurizing chambers and the first individual flow paths 12 connected to the fourth pressurizing chambers, can be disposed alternately.

REFERENCE SIGNS LIST

1 COLOR INK JET PRINTER
2 LIQUID DISCHARGE HEAD
2*a* HEAD MAIN BODY
4 (FIRST) FLOW PATH MEMBER
4*a* to 1 PLATE
4-1 PRESSURIZING CHAMBER SURFACE
4-2 DISCHARGE HOLE SURFACE
6 SECOND FLOW PATH MEMBER
6*a* THROUGH HOLE (OF SECOND FLOW PATH MEMBER)
8 DISCHARGE HOLE
9A DISCHARGE HOLE ROW
10 PRESSURIZING CHAMBER
10*a* PRESSURIZING CHAMBER MAIN BODY
10*b* PARTIAL FLOW PATH
11A PRESSURIZING CHAMBER ROW
12 FIRST INDIVIDUAL FLOW PATH
14 SECOND INDIVIDUAL FLOW PATH
14*a* FIRST PART (OF SECOND INDIVIDUAL FLOW PATH)
14*b* SECOND PART (OF SECOND INDIVIDUAL FLOW PATH)
16 PRESSURIZING CHAMBER DISPOSITION REGION

20 FIRST COMMON FLOW PATH (COMMON SUPPLY FLOW PATH)
20*a* FIRST COMMON FLOW PATH MAIN BODY
20*b* OPENING (OF FIRST COMMON FLOW PATH)
22 SECOND COMMON FLOW PATH (COMMON DISCHARGE FLOW PATH)
22*a* SECOND COMMON FLOW PATH MAIN BODY
22*b* OPENING (OF SECOND COMMON FLOW PATH)
24 FIRST INTEGRATED FLOW PATH
24*a* FIRST INTEGRATED FLOW PATH MAIN BODY
24*b* OPENING (OF FIRST INTEGRATED FLOW PATH)
26 SECOND INTEGRATED FLOW PATH
26*a* SECOND INTEGRATED FLOW PATH MAIN BODY
26*b* OPENING (OF SECOND INTEGRATED FLOW PATH)
40 PIEZOELECTRIC ACTUATOR SUBSTRATE
40*a* PIEZOELECTRIC CERAMIC LAYER
40*b* PIEZOELECTRIC CERAMIC LAYER (DIAPHRAGM)
42 COMMON ELECTRODE
44 INDIVIDUAL ELECTRODE
44*a* INDIVIDUAL ELECTRODE MAIN BODY
44*b* EXTRACTION ELECTRODE
46 CONNECTION ELECTRODE
50 DISPLACEMENT ELEMENT (PRESSURIZING UNIT)
70 HEAD-MOUNTED FRAME
72 HEAD GROUP
80A PAPER FEED ROLLER
80B COLLECTION ROLLER
82A to D TRANSPORT ROLLER
88 CONTROL UNIT
P PRINTING PAPER SHEET

The invention claimed is:

1. A liquid discharge head comprising:
a flow path member comprising
a plurality of pressurizing chambers including a first pressurizing chamber and a second pressurizing chamber,
a first common flow path commonly connected to the first pressurizing chamber and the second pressurizing chamber, and
a second common flow path commonly connected to the first pressurizing chamber and the second pressurizing chamber; and
a pressurizing unit that pressurizes each pressurizing chamber of the plurality of pressurizing chambers, wherein
the first common flow path extends in a first direction and is open to an outside of the flow path member at both end portions of the flow path member,
the second common flow path extends in the first direction and is open to the outside of the flow path member at the both end portions,
the plurality of pressurizing chambers further comprises a third pressurizing chamber and a fourth pressurizing chamber,
the first common flow path further comprises first and second openings at the both ends, respectively,
the second common flow path further comprises third and fourth openings at the both ends, respectively,
the liquid discharge head further comprising:
a third common flow path commonly connected to the third pressurizing chamber and the fourth pressurizing chamber, extending in the first direction, and open to an outside of the flow path member at both ends that comprise fifth and sixth openings, respectively,
a fourth common flow path commonly connected to the third pressurizing chamber and the fourth pressurizing chamber, extending in the first direction, and open to an outside of the flow path member at both ends that comprise seventh and eighth openings, respectively
a first integrated flow path comprising a first portion and a second portion,
a second integrated flow path comprising a third portion and a fourth portion, wherein
the first opening and the fifth opening are on a line in a second direction different from the first direction, and are below the first portion of the first integrated flow path,
the second opening and the sixth opening are on a line in the second direction, and are below the second portion of the first integrated flow path,
the third opening and the seventh opening are on a line in the second direction, and are below the third portion of the second integrated flow path, and
the fourth opening and the eighth opening are on a line in the second direction, and are below the fourth portion of the second integrated flow path.

2. A liquid discharge head comprising:
a flow path member comprising
a plurality of pressurizing chambers including a first pressurizing chamber and a second pressurizing chamber,
a first common flow path commonly connected to the first pressurizing chamber and the second pressurizing chamber, and
a second common flow path commonly connected to the first pressurizing chamber and the second pressurizing chamber;
a pressurizing unit that pressurizes each pressurizing chamber of the plurality of pressurizing chambers
a local flow path connected to a discharge hole from which a part of the liquid is ejected, wherein
the first common flow path and the second common flow path are disposed along a first direction,
the plurality of pressurizing chambers are disposed along the first common flow path and the second common flow path,
a liquid is supplied to the first common flow path on an outside of a disposition range, in which the plurality of pressurizing chambers is disposed, in the first direction and on an outside of the disposition range in a third direction opposite to the first direction,
the liquid in the second common flow path is collected on the outside of the disposition range in the first direction and on the outside of the disposition range in the third direction,
the local flow path allows the liquid to flow from the first pressurizing chamber to the second common flow path, and
the local flow path comprises:
a first section having a first height; and
a second section having a second height that is larger than the first height, the second section closer to the second common flow path than the first section.

3. The liquid discharge head according to claim 1 wherein
each of the plurality of pressurizing chambers comprises
a pressurizing chamber main body that faces the pressurizing unit, and a partial flow path that connects the pressurizing chamber main body to a discharge hole, and the first common flow path is connected to the pressurizing chamber main body, and the second common flow path is connected to the partial flow path.

4. The liquid discharge head according to claim 1, wherein the first common flow path overlaps the second common flow path.

5. The liquid discharge head according to claim 4, wherein a damper chamber is disposed at a position where the first common flow path overlaps the second common flow path, and wherein a first damper is on a first common flow path side of the damper chamber and a second damper is on a second common flow path side of the damper chamber.

6. The liquid discharge head according to claim 1 wherein an opening of the second common flow path on a first direction side is disposed farther in the first direction relative to an opening of the first common flow path on the first direction side, and an opening of the second common flow path on a third direction side is disposed farther in a third direction, that is opposite to the first direction, relative to an opening of the first common flow path on the third direction side.

7. The liquid discharge head according to claim 1 wherein each of the plurality of pressurizing chambers comprises a pressurizing chamber main body that faces the pressurizing unit, and a partial flow path that connects the pressurizing chamber main body to a discharge hole, the first common flow path and the pressurizing chamber main body are connected via a first individual flow path, and an opening of the first individual flow path on a pressurizing chamber main body side is disposed on a side opposite to an opening of the partial flow path on the pressurizing chamber main body side with respect to an area center of gravity of the pressurizing chamber main body, pressurizing chamber main bodies of the plurality of pressurizing chambers have a three-fold shape or a more rotational symmetry in a plan view, and are disposed in a state of not substantially rotating with respect to each other, the plurality of pressurizing chambers connected to the first common flow path along the first common flow path comprise four pressurizing chamber rows on both sides of the first common flow path, and when the four pressurizing chamber rows comprise a first pressurizing chamber row, a second pressurizing chamber row, a third pressurizing row and a fourth pressurizing chamber row in an order in a second direction that intersects with the first direction, an opening of the partial flow path on the pressurizing chamber main body side is disposed farther than the area center of gravity of the pressurizing chamber main body with respect to the first common flow path in the second and third pressurizing chamber rows, a relative position of the opening of the first individual flow path on the pressurizing main body side to the area center of gravity of the pressurizing chamber main body in the first and fourth pressurizing chamber rows, is closer to a first common flow path side than a relative position of the opening of the first individual flow path on the pressurizing chamber main body side to the area center of gravity of the pressurizing chamber main body in the second and third pressurizing chamber rows, the first individual flow path that corresponds to the first pressurizing chamber row and the first individual flow path that corresponds to the third pressurizing chamber row extend toward each other and do not overlap each other in the second direction, and the first individual flow path that corresponds to the second pressurizing chamber row and the first individual flow path that corresponds to the fourth pressurizing chamber row extend toward each other and do not overlap each other in the second direction.

8. A recording apparatus comprising:

the liquid discharge head according to claim 1 and a liquid supply tank that supplies a liquid to the liquid discharge head, wherein a viscosity of the liquid stored in the liquid supply tank is 5 mPa's or higher and 15 mPa's or lower.

9. A recording apparatus comprising:

the liquid discharge head according to claim 1 and a liquid supply tank that supplies a liquid to the liquid discharge head, wherein the liquid supply tank comprises a stirring unit that stirs the liquid.

10. A recording apparatus comprising:

the liquid discharge head according to claim 1 an imaging unit; and a control unit; wherein the imaging unit captures image date of a liquid discharged from the liquid discharge head or image date of an image formed by the liquid that has landed on a recording medium, and the control unit changes print data to be sent to the liquid discharge head based on the image data captured by the imaging unit.

11. A recording apparatus comprising:

the liquid discharge head according to claim 1 a head chamber in which the liquid discharge head is accommodated; and a control unit;

wherein the control unit controls at least one of temperature, humidity, and atmospheric pressure in the head chamber.

12. A recording apparatus comprising:

the liquid discharge head according to claim 1 and a movable unit that moves a position of a recording medium relative to the liquid discharge head.

13. The recording apparatus according to claim 12, wherein the movable unit moves the recording medium relative to the liquid discharge head at a speed of 100 m/min or higher.

14. A recording method for a liquid discharge head, the method comprising;

supplying a liquid to a first common flow path commonly connected to a first pressurizing chamber and a second pressurizing chamber of a plurality of pressurizing chambers pressurized by a pressurizing unit, the liquid supplied from an outside of a disposition range, in which the plurality of pressurizing chambers is disposed, in a first direction, and supplied from an outside of the disposition range in a third direction opposite to the first direction, in the first common flow path;

discharging, via discharge hole connected to a local flow path, part of the liquid by driving the pressurizing unit; and collecting the liquid, which is not discharged, from both the outside of the disposition range in the first direction, and from the outside of the disposition range in the third direction, in a second common flow path that is disposed along the first direction and that is commonly connected to the first pressurizing chamber and the second pressurizing chamber, wherein the liquid flows from the first pressurizing chamber to the second common flow path via the local flow path, and the local flow path comprises:

a first section having a first height; and a second section having a second height that is larger than the first height, the second section closer to the second common flow path than the first section.

* * * * *